United States Patent [19]

Konishi et al.

[11] Patent Number: 4,637,866

[45] Date of Patent: Jan. 20, 1987

[54] RECOVERY METHOD OF TRITIUM FROM TRITIATED WATER

[75] Inventors: Satoshi Konishi, Tokaimura; Hideo Ohno, Mito; Yuji Naruse, Tokaimura; Hiroshi Yoshida, Mito, all of Japan

[73] Assignee: Japan Atomic Energy Research Institute, Tokyo, Japan

[21] Appl. No.: 785,091

[22] Filed: Oct. 4, 1985

Related U.S. Application Data

[63] Continuation of Ser. No. 587,010, Mar. 7, 1984, abandoned.

[30] Foreign Application Priority Data

Mar. 18, 1983 [JP] Japan ..... 58-044394

[51] Int. Cl.[4] ..... C25B 1/02

[52] U.S. Cl. ..... 204/129

[58] Field of Search ..... 204/129

[56] References Cited

U.S. PATENT DOCUMENTS 4,304,645 12/1981 Pierini ..... 204/129

4,427,504 1/1984 Stuchi ..... 204/129

*Primary Examiner*—R. L. Andrews

*Attorney, Agent, or Firm*—Schwartz & Weinrieb

[57] ABSTRACT

The present invention is concerned with a process for recovering tritium from tritiated water wherein a gas stream containing tritiated water steam is conducted into an electrolytic cell within which is disposed an oxygen ion conductive solid electrolytic membrane having a cathode and an anode disposed upon the opposite surfaces thereof. As a result of the electrolysis process, tritium gas is collected from the cathode side of the electrolytic cell, while oxygen gas is collected from the anode side of the electrolytic cell.

1 Claim, 1 Drawing Figure

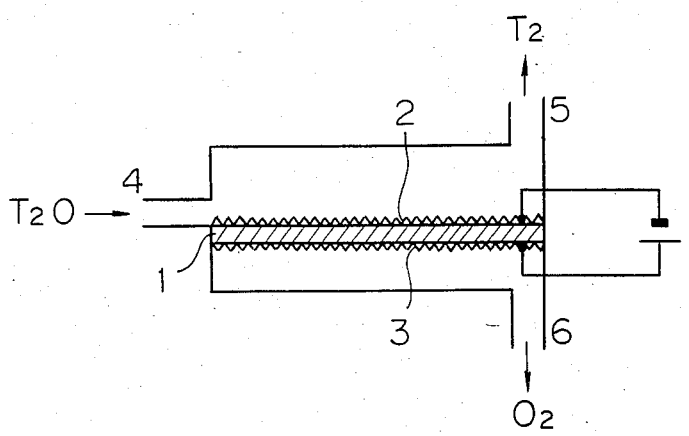
T2
2
5
4
T2O
1
3
6
O2

RECOVERY METHOD OF TRITIUM FROM TRITIATED WATER

This application is a continuation of application Ser. No. 587,010, filed Mar. 7, 1984, now abandoned.

FIELD OF THE INVENTION

The present invention relates to a process for recovering tritium from tritiated water. More particularly, the present invention relates to a process for recovering tritium in a chemical form of hydrogen gas by decomposing tritiated water and is characterized by electrolyzing steam on an electrolytic membrane made of ceramic material.

BACKGROUND OF THE INVENTION

The recovery of tritium by the decomposition of tritiated water in middle or high level is considered to be necessary for the handling of fuel for nuclear fusion or for the reprocessing of spent fuel used in the future, however, presently we do not have an established process in Japan. In the United States of America, a process for reducing steam with an activated metal such as uranium is now used, however, a periodical replacement of the metal is required for achieving a continuous operation because the metal is consumed with the reaction. An operation for replacing an apparatus for radioactive substance is in danger because of contamination and the like. Also the material removed must be treated as radioactive waste, and in addition, uranium metal is very expensive and is difficult to handle for it is a nuclear fuel material.

A process for decomposing tritiated water by using a solid polymer electrolyte has been tried in the United States, however, organic materials have been found to suffer from radiation damage as result of the disintegration of tritium, and therefore the process has not yet been put into practical use.

The electrolysis of water using an alkaline solution is possible in principle, however, since the tritium inventory required in the form of an electrolyte in the apparatus is extremely large, such electrolysis is not practical as a process for treating tritium which is expensive and high in specific activity, and therefore, this process has not been tried.

OBJECT OF THE INVENTION

An object of the present invention is to provide a process for recovering tritium from tritiated water in the gaseous phase without the aforenoted defects, that is, periodic replacement of materials, radiation damage and the generation of radioactive wastes.

SUMMARY OF THE INVENTION

As the result of conducting exhaustive research, the present inventors have found that the recovery of tritium from tritiated water can be more effectively carried out in an electrolysis cell using an oxygen ion conductive solid electrolytic membrane and have accomplished the aforenoted object by a process for recovering tritium from tritiated water which comprises the steps of passing an electric current between the electrodes fitted upon both faces of an oxygen ion conductive solid electrolyte membrane while supplying a gas containing tritiated water steam to the membrane and thus converting said tritiated water to tritium by electrolysis, and on the other hand removing oxygen not contaminated with tritium from the opposite side of the membrane.

BRIEF DESCRIPTION OF THE DRAWINGS

Various other objects, features, and attendant advantages of the present invention will be more fully appreciated as the same becomes better understood from the following detailed description when considered in connection with the accompanying drawing wherein:

The sole FIGURE is a schematic drawing of an electrolysis system, including an electrolytic cell, for recovering tritium gas from tritiated water in accordance with the process of the present invention.

DETAILED DESCRIPTION OF THE PREFERRED EMBODIMENTS

The drawing appended shows an outline of one embodiment of the process of the present invention for recovering tritium from tritiated water.

The electrolytic cell is divided into two chambers by means of a diaphragm comprising an electrolytic membrane, 1 and a cathode 2 and anode 3 fitted on the surface thereof. Tritiated water ($T_2O$) is supplied through a gas inlet 4 in the cathode side of the cell by a stream of pure steam or argon gas and reduced to tritium gas ($T_2$) on the surface of cathode 2. The tritiated water supplied is converted to tritium gas ($T_2$) in a high yield amount under such a condition that the gaseous reactant sufficiently contacts the electrode and the tritium gas ($T_2$) is recovered from a gas outlet 5. On the other hand, oxygen is produced by the decomposition of water passing through the electrolyte in an ionic state so as to generate oxygen gas $O_2$ on the anode 3 and is exhausted from an oxygen outlet 6. The oxygen is not contaminated by the tritium or tritiated water because the latter do not permeate through the electrolytic membrane 1.

As the electrolytic membrane 1, a sintered material of zirconium oxide added with calcium oxide, magnesium oxide, yttrium oxide, ytterbium oxide (stabilized zirconia), cerium oxide, thorium oxide, bismuth oxide, or the like, is usable, but in order to obtain sufficient electrical conductivity of the oxygen ions an elevated temperature of 500° to 1000° C. is required. The electrode can be obtained by calcining an electrolytic membrane coated with a platinum paste at about 1000° C. although it may be prepared by flame spraying an electrical conductive material such as cermet and lanthanum cobaltite ($LaCoO_3$).

In the experiment of a recovering of hydrogen from steam in an argon stream in an electrolysis cell comprising an electrolytic membrane prepared by sintering a solid solution of yttrium oxide and zirconium oxide in a tublar form and the above mentioned platinum electrode, a recovery rate of greater than 99.5% was obtained within the temperature range of 600° to 950° C.

What is claimed is:

1. A process for recovering tritium gas from tritiated water, comprising the steps of:

disposing an oxygen ion-conductive solid electrolytic membrane, having a cathode and an anode disposed upon opposite sides thereof, within an electrolytic cell;

applying electricity to said cathode and anode electrodes of said electrolytic membrane;

conducting a gas stream, containing tritiated water steam, into said electrolytic cell such that said gas stream only contacts said cathode electrode of said electrolytic membrane;

recovering tritium gas only from said cathode side of said electrolytic cell; and recovering oxygen gas only from said anode side of said electrolytic cell.

* * * * *